US011959717B2

(12) United States Patent
Santa et al.

(10) Patent No.: US 11,959,717 B2
(45) Date of Patent: Apr. 16, 2024

(54) LOADING AID OF A FIREARM

(71) Applicant: Carl Walther GmbH, Ulm (DE)

(72) Inventors: Philipp Santa, Ulm (DE); Eyck Pflaumer, Arnsberg (DE); Martin Wonisch, Arnsberg (DE)

(73) Assignee: Carl Walther GmbH, Ulm (DE)

( * ) Notice: Subject to any disclaimer, the term of this patent is extended or adjusted under 35 U.S.C. 154(b) by 58 days.

(21) Appl. No.: 17/868,051

(22) Filed: Jul. 19, 2022

(65) Prior Publication Data

US 2023/0029097 A1 Jan. 26, 2023
US 2023/0417503 A9 Dec. 28, 2023

(30) Foreign Application Priority Data

Jul. 20, 2021 (DE) ..... 10 2021 118 646.3

(51) Int. Cl.
*F41A 3/72* (2006.01)
*F41A 19/36* (2006.01)

(52) U.S. Cl.
CPC ..... *F41A 3/72* (2013.01); *F41A 19/36* (2013.01)

(58) Field of Classification Search
CPC ..... F41A 3/72
USPC ..... 42/14
See application file for complete search history.

(56) References Cited

U.S. PATENT DOCUMENTS 2,717,464 A 9/1955 Marcati
5,604,326 A 2/1997 Lescure
5,678,340 A 10/1997 Moon
8,028,454 B1 10/2011 Pontillo, II
8,966,800 B1 3/2015 Olson
9,291,413 B1 * 3/2016 Viani ..... F41A 3/72
D761,374 S * 7/2016 Ellsworth ..... F41A 3/72 D22/108
9,518,791 B1 12/2016 Heizer et al.
9,664,471 B1 * 5/2017 Curry ..... F41A 3/72
9,746,283 B2 8/2017 Braun
11,287,199 B1 * 3/2022 Cahill ..... F41A 3/72
2006/0185212 A1 8/2006 Curry et al.
2011/0041680 A1 2/2011 Smirnov
2011/0154710 A1 6/2011 Hatfield
2012/0198744 A1 8/2012 Meller et al.
2014/0196339 A1 7/2014 Zukowski et al.
(Continued)

FOREIGN PATENT DOCUMENTS

EP 0786640 A1 7/1997
GB 500621 A 2/1939

OTHER PUBLICATIONS

German Office Action dated Feb. 21, 2022 for German Patent Office Action No. 102021118646 (with electronic translation).
(Continued)

*Primary Examiner* — Bret Hayes
(74) *Attorney, Agent, or Firm* — Bachman & LaPointe, P.C.

(57) ABSTRACT

A loading aid which projects beyond the lateral faces (220, 230) of the slide (200) and is attached in the region of a rear end face (210) of the slide (200) of a firearm is created by a panel (110) which projects beyond the lateral faces (220, 230) of the slide (200) with at least one of its lateral regions (120, 130) lying opposite one another and is introduced into a horizontally oriented recess (211) in the rear end face (210) of the slide (200).

19 Claims, 6 Drawing Sheets

(56) References Cited

U.S. PATENT DOCUMENTS

| | | | | |
|---|---|---|---|---|
| 2014/0298703 | A1* | 10/2014 | Gale | F41A 3/72 42/71.02 |
| 2015/0121734 | A1 | 5/2015 | Kresser | |
| 2016/0231075 | A1 | 8/2016 | Wolf | |
| 2017/0261279 | A1 | 9/2017 | Lee | |
| 2018/0087857 | A1 | 3/2018 | Davis et al. | |
| 2021/0318085 | A1 | 10/2021 | Kling et al. | |
| 2021/0364244 | A1 | 11/2021 | Kling et al. | |

OTHER PUBLICATIONS

German Office Action dated Dec. 9, 2020 for German Patent Application No. 10 2020 108 231.2.
Exploded drawing and parts list: "Creed", Jun. 8, 2016, Carl Walther GmbH, Ulm, Germany.
Exploded drawing and parts list: "PPQ", Jan. 11, 2018, Carl Walther GmbH, Ulm, Germany.
Exploded drawing and parts list: "PPX M1", Jul. 28, 2014, Carl Walther GmbH, Ulm, Germany.
U.S. Office action dated Mar. 17, 2022 for U.S. Appl. No. 17/159,438.
"Spare Parts Catalogue: SFP9-SF Pistol", Sep. 2015, Heckler & Koch GmbH, Oberndorf, Germany.

* cited by examiner

LOADING AID OF A FIREARM

CROSS-REFERENCE TO RELATED APPLICATION

Priority is claimed of German Patent Application No. DE 10 2021 118 646.3, filed Jul. 20, 2021, and entitled "Loading Aid of a Firearm", the disclosure of which is incorporated by reference herein in its entirety as if set forth at length.

BACKGROUND

The invention relates to a loading aid which projects beyond the lateral faces of the slide (the rear of the breechblock section of the slide) and is attached in the region of a rear end face of the slide of a firearm.

Such a loading aid effectively forms a pistol charging handle, with a pair of oppositely protruding tabs gripable between the thumb and forefinger (or forefinger and middle finger) of one hand to pull back/retract the slide while the other hand holds the pistol grip. Releasing the tabs allows the slide to be driven forward by the slide spring to strip a round from the magazine. Such a loading aid may also be used to retract the slide to dechamber/eject an ammunition round or case. Loading aids of the kind referred to above are realized in the prior art in the SFP 9 pistol made by Heckler and Koch (U.S. Pat. No. 9,746,283, of Braun, Aug. 29, 2017, "Cocking tab inserts and breechblock slides and firearms including the same"). However, this loading aid which is known in the art has the disadvantage that it is held by the rear sight of the slide. To this extent, forces acting on the loading aid also act on the sights, meaning that their stability and accuracy is compromised.

SUMMARY

The problem addressed by the invention is therefore that of creating a loading aid which has an integral design and is directly fastened to the slide, while avoiding an at least direct mechanical connection to the sights.

For a loading aid of the kind referred to above, this problem is solved according to the invention by a pin element (e.g., formed as a panel) which projects beyond the lateral faces of the slide with at least one of the lateral regions lying opposite one another and is introduced into a horizontally oriented recess in the rear end face of the slide.

Preferred embodiments of the invention are the subject matter of the dependent claims, the elements of which act as a further improvement in the approach to solving the problem underlying the invention.

In the case of the loading aid according to the invention, by means of the combination of features, wherein a pin element is provided which projects beyond the lateral faces of the slide with at least one of the lateral regions lying opposite one another and is introduced into a horizontally oriented recess in the rear end face of the slide, it is achieved in conjunction with the features of a loading aid of the kind referred to above that an integrally formed loading aid is created, which is fastened straight to the slide and, to this extent, can be attached to, or removed from, the firearm, or replaced, without other assemblies which are fastened to the slide, such as sights, for example, having to be removed beforehand.

Moreover, it is possible for the loading aid according to the invention to be attached without significant additional work, since a plurality of components which routinely exist in a pistol is called upon, the functionality of which components has been enhanced for the purpose of attaching the loading aid according to the invention.

In accordance with a first preferred embodiment of the loading aid according to the invention, it is provided that the two opposite lateral regions of the pin element project beyond the lateral faces of the slide in a symmetrically identical configuration.

In accordance with an important preferred embodiment of the loading aid according to the invention, the pin element is configured as a plan-parallel panel, whereof at least one lateral region projecting beyond the lateral faces of the slide is oriented at a predefined angle to the main surfaces of the pin element which are plan parallel to one another. The size of the angle in this case is preferably between 30° and 70° and, in particular, roughly 45°.

Furthermore, the at least one lateral region of the pin element preferably projects 1 mm to 5 mm and, in particular roughly 3 mm, beyond a respective lateral face of the slide.

In the case of the loading aid according to the invention, it is also possible, on the other hand, for a lateral region of the pin element which projects beyond a respective lateral face of the slide to have a concave, convex or concave/convex design.

A lateral region of the pin element which projects beyond a respective lateral face of the slide is preferably provided with grooving in this case, wherein three to five groove edges and, in particular, four grooves are preferably formed.

In accordance with a further important preferred embodiment of the loading aid according to the invention, the panel is held within the recess in the slide in a form-fitted manner allowing lateral displacement.

A form-fitted attachment of the panel is, for example, facilitated in that the longitudinal edges of the plan-parallel panel running parallel to one another are each provided with a step or a dovetail, in such a manner that the inner surface of the panel has a greater height than the outer face of the panel, in order to bring about a secure fit of the panel within the recess, following a lateral introduction of the panel into the correspondingly configured, horizontally oriented recess in the rear end face of the slide.

The horizontally oriented recess in the rear end face of the slide is preferably arranged in such a manner that the outer face of the panel ends flat with respect to the rear end face of the slide.

In accordance with another important preferred embodiment of the loading aid according to the invention, a recess is formed in a central region of the inner surface of the panel, which recess is dimensioned for a coherent introduction of a rear end face of a socket which is biased in the direction of the recess, for the purpose of locking the panel laterally within the rear end face of the slide. The recess may, in particular, be circular in design.

As a concrete embodiment in this respect, a recess is formed in a central region of the inner surface of the panel, which recess is dimensioned for a coherent introduction of a rear end face of a socket which is attached to the respective end of an extractor spring, or in the region of an end of a firing pin spring lying opposite the firing pin, and biased in the direction of the recess, for the purpose of locking the panel laterally within the rear end face of the slide.

At least one bore is preferably formed within the recess, said bore being dimensioned to allow compression of a spring by means of a pin which is to be introduced. Two bores spaced at a predefined distance from the central longitudinal axis of the slide may be provided.

BRIEF DESCRIPTION OF THE DRAWINGS

The loading aid according to the invention is explained below with the help of a preferred embodiment which is depicted in the figures of the drawing. In the drawing.

DETAILED DESCRIPTION

Figure 1:
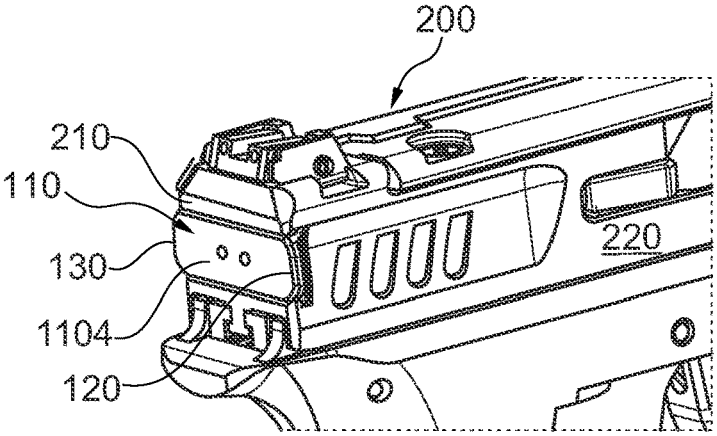
FIG. 1 shows a firearm with a first preferred embodiment of the loading aid according to the invention in an oblique view from behind.
Figure 2:
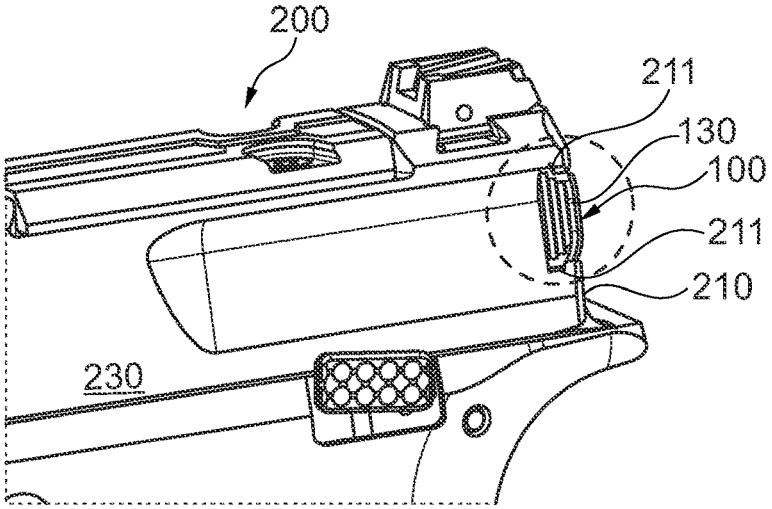
FIG. 2 shows the preferred embodiment of the loading aid according to the invention depicted in FIG. 1 in a first side view.
Figure 3:
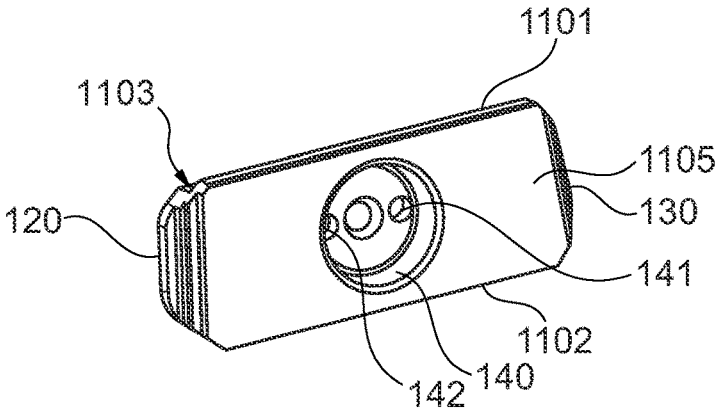
FIG. 3 shows the preferred embodiment of the loading aid according to the invention depicted in FIG. 1 in a second side view.
Figure 4:
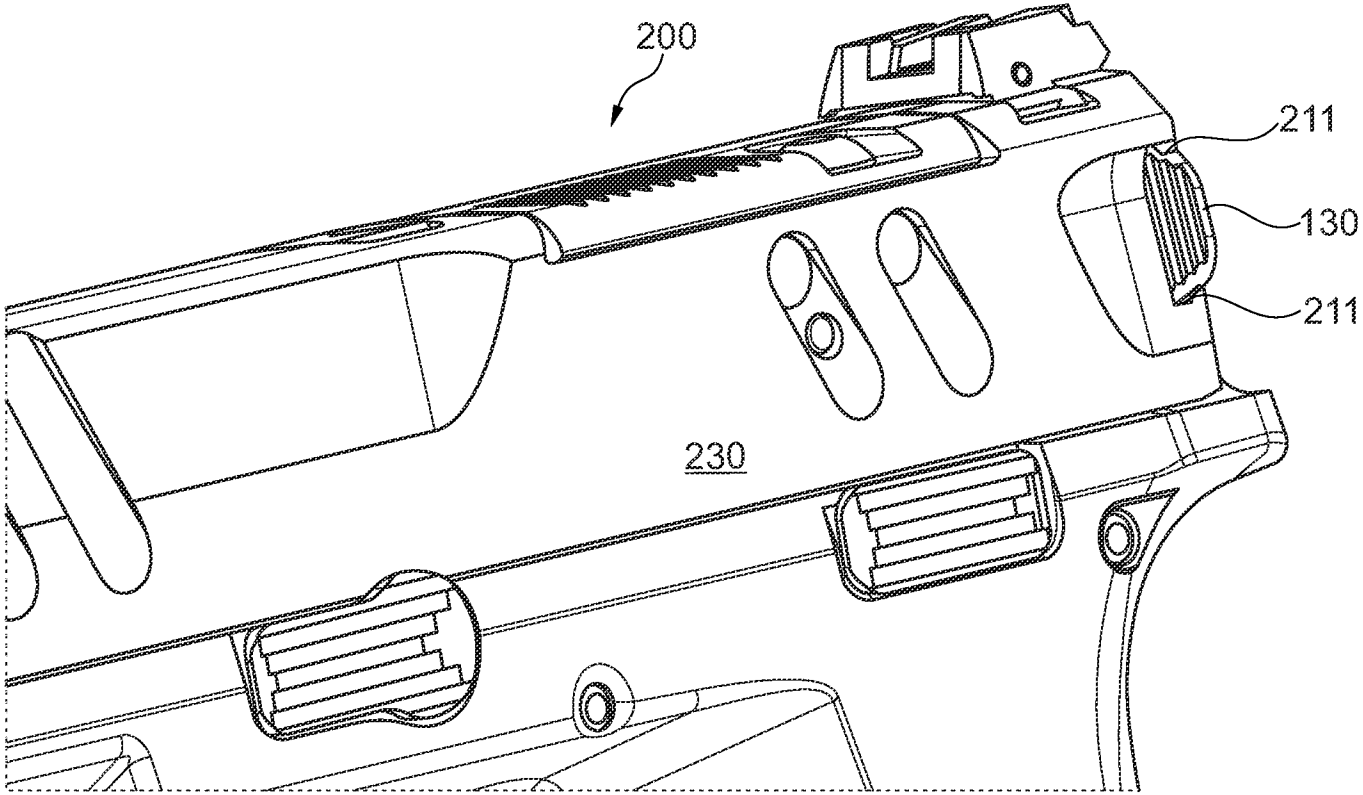
FIG. 4 shows a further preferred embodiment of the loading aid according to the invention in a side view.
Figure 5:
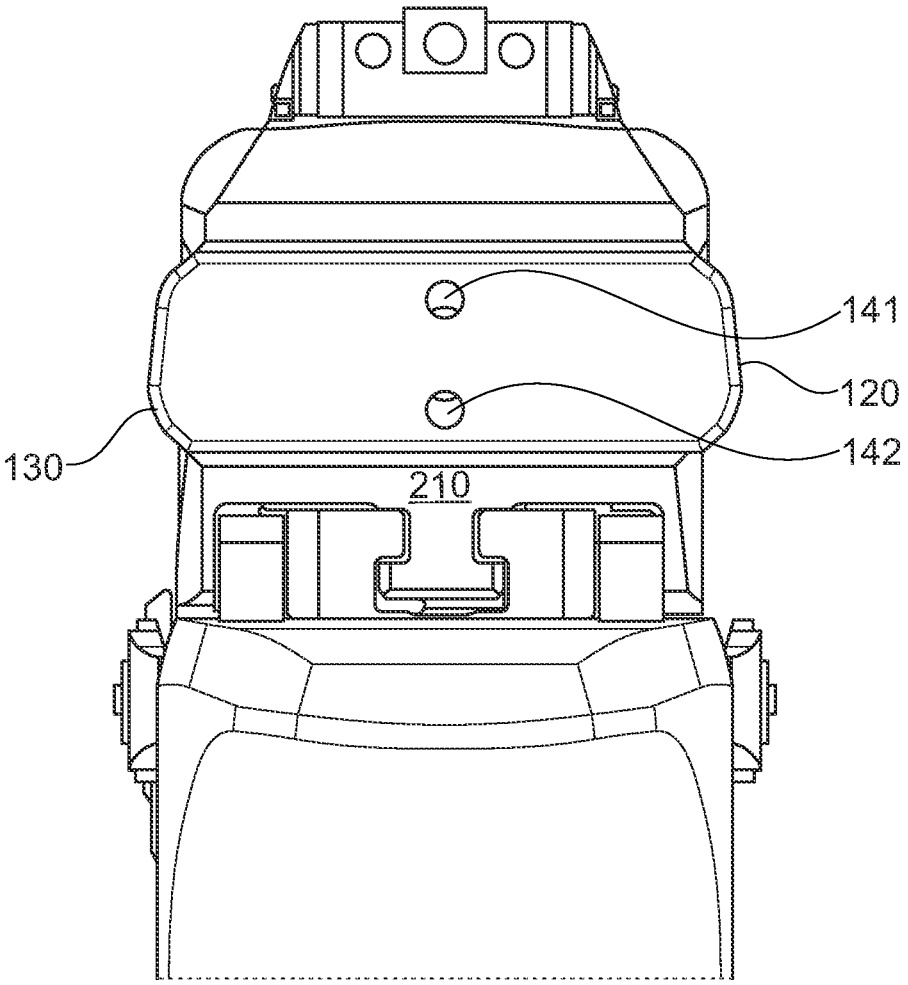
FIG. 5 shows the preferred embodiment of the loading aid according to the invention depicted in FIG. 4 in a view from behind.
Figure 6:
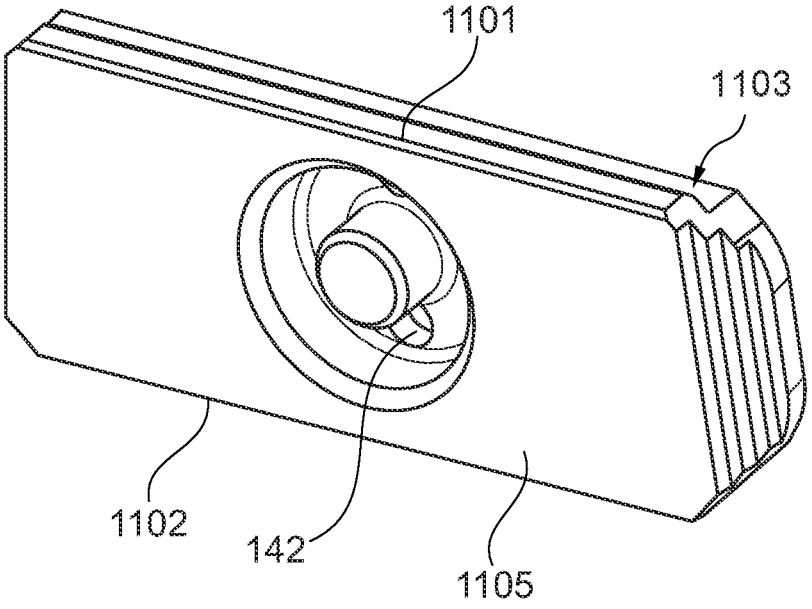
FIG. 6 shows the preferred embodiment of the loading aid according to the invention depicted in FIG. 4 in a view of the inner surface.

The loading aid 100 according to the invention depicted in FIGS. 1 to 3, and likewise in FIGS. 4 to 7, is attached in the region of a rear end face 210 of the slide 200 of a firearm (FIG. 8), wherein a pin element (panel) 110, which projects beyond the lateral faces 220, 230 of the slide 200 with the two lateral regions 120, 130 lying opposite one another, is introduced into a horizontally oriented recess 211 in the rear end face 210 of the slide 200. The recess 211 is laterally and rearwardly open, The two lateral regions 120, 130 of the pin element 110 lying opposite one another project beyond the lateral faces 220, 230 of the slide 200 (namely an aft/breech section of the slide aft of a breech face) in a symmetrically identical configuration.

The pin element 110 is configured as a plan-parallel panel, whereof at least one lateral region 120 projecting beyond the lateral faces 220, 230 of the slide 200 is oriented at a predefined angle of 45° to the main surfaces 1104 and 1105 of the pin element 110 which are plan-parallel (flat and parallel) to one another.

The two lateral regions 120, 130 of the pin element 110 configured as a panel project roughly 3 mm beyond a respective lateral face 220, 230 of the slide 200, wherein these lateral regions 120, 130 of the pin element 110 are provided with external grooving which comprises four groove edges in each case.

The pin element 110 configured as a panel is held within the recess 211 in the slide 200 in a form-fitted manner allowing lateral displacement, in such a manner that the longitudinal edges 1101, 1102 of the plan-parallel panel running parallel to one another are each provided with a step 1103, wherein the inner (forward) surface 1105 of the panel 110 has a greater height than the outer (aft) surface 1104 of the panel 110, in order to bring about a secure fit of the panel 110 within the recess 211, following a lateral introduction of the panel 110 into the correspondingly configured, horizontally oriented recess 211 in the rear end face 210 of the slide 200.

The horizontally oriented recess 211 in the rear end face 210 of the slide 200 is arranged in such a manner that the outer surface 1104 of the panel ends flat with respect to the rear end face 210 of the slide 200.

A recess 140 is formed in a central region of the inner surface 1105 of the panel, which recess is dimensioned for an introduction of a rear end face of a socket (spring cap) 150 in the region of a rear end of a firing pin spring 300 and biased in the direction of the recess 140, for the purpose of locking the panel 110 laterally within the rear end face 210 of the slide 200. The spring cap surrounds a rear end portion of the firing pin spring. The firing pin and spring extend with in a firing pin compartment in the breech section of the slide with a forward end of the firing pin extendable through the breech face when driven by the spring 300 for firing.

Figure 7:
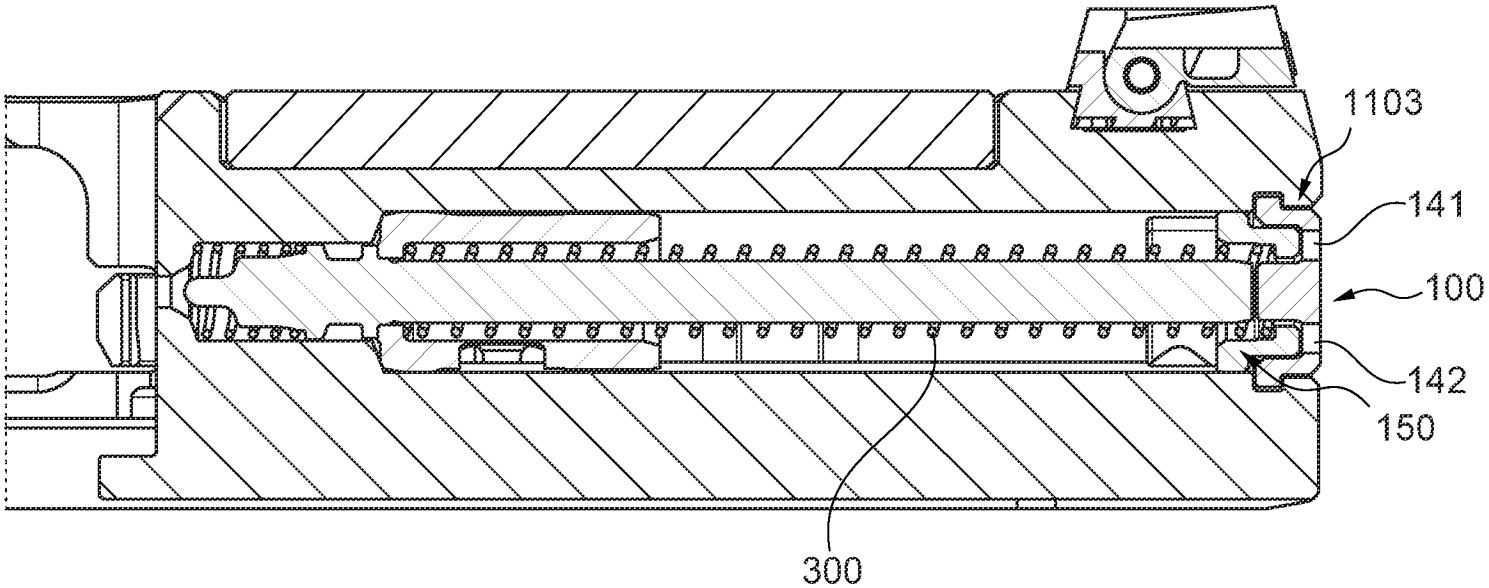
FIG. 7 shows the preferred embodiment of the loading aid according to the invention depicted in FIG. 4 in a cross-sectional view.
Figure 8:
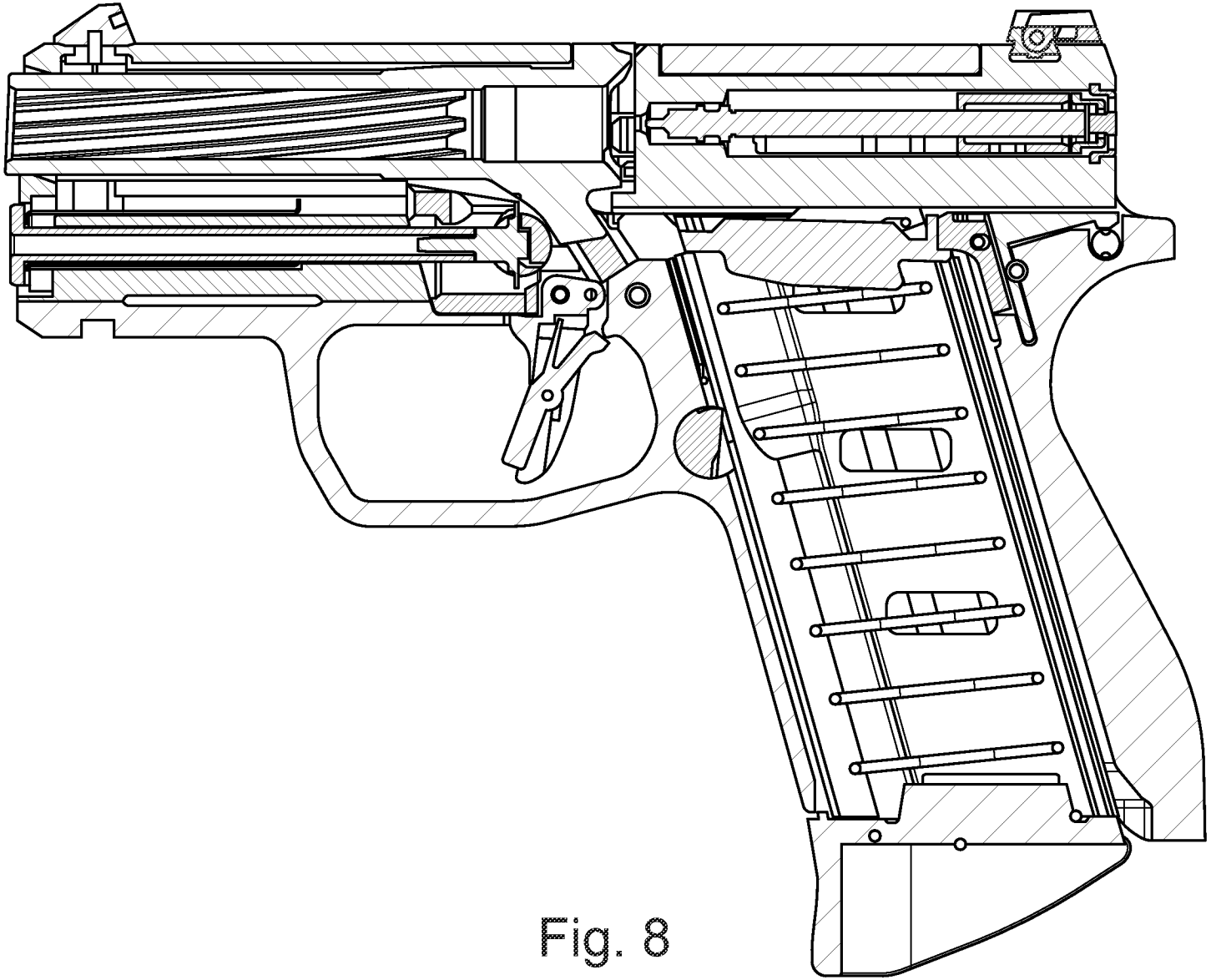
FIG. 8 is a central vertical/longitudinal sectional view of the firearm.

Depending on configuration, the spring 300 may act directly on the firing pin or may drive an inertial striker that impacts the firing pin. FIG. 7 shows an inertial striker in a forward/extended condition with relatively uncompressed spring 300 and a small gap between the firing pin rear end and a central projection of the panel; whereas FIG. 8 shows the inertial striker in a relatively rearward/retracted condition with the pin slightly further retracted under influence of a smaller firing pin return spring so that the rear end of the firing pin contacts the projection.

Two bores 141, 142 spaced at a predefined distance from the central longitudinal axis of the slide 200 are provided within the recess 140 at a predefined distance from the central longitudinal axis, which bores (holes) are dimensioned to allow compression of the spring 300 by means of a respective pin which is to be introduced. In particular, a pair of pins may pass through the bores to depress the spring cap and disengage the spring cap from the recess 140 to allow the panel 110 to be laterally slid out of the recess 211 (via cooperation of upper and lower rails (formed by the upper and lower steps 1103 and adjacent edges) of the panel in respective slots in the slide). Panel removal allows withdrawal of the firing pin assembly from the rear opening of a firing pin compartment previously closed by the panel. Firing pin and panel installation may be via the reverse.

The exemplary embodiment of the invention explained above serves simply to provide greater understanding of the inventive teaching embodied in the claims, which is not limited as such by the exemplary embodiment.

LIST OF REFERENCE SIGNS

Below is a list of reference signs used in the drawings:

100 loading aid
110 pin element configured as a panel
120, 130 lateral regions lying opposite one another
140 recess
141, 142 bore
150 spring cap (socket)
200 slide
210 rear end face
211 recess
220, 230 lateral faces
300 firing pin spring
1101, 1102 longitudinal edges running parallel to one another
1103 step or dovetail
1104 outer surface of the pin element
1105 inner surface of the pin element

What is claimed is:

1. Loading aid (100) for a firearm, the firearm having a slide (200) and the slide having lateral faces (220, 230) and a rear end face (210), wherein:

the loading aid projects beyond the lateral faces (220, 230) of the slide (200) and is attached in a region of the rear end face (210) of the slide (200);

the loading aid comprises a panel (110) projecting beyond the lateral faces (220, 230) of the slide (200) and having lateral regions (120, 130) lying opposite one another and is introduced into a horizontally oriented recess (211) in the rear end face (210) of the slide (200) by lateral sliding.

2. Loading aid according to claim 1, characterized in that the lateral regions (120, 130) of the panel (110) lying opposite one another project beyond the lateral faces (220, 230) of the slide (200) in a symmetrically identical configuration.

3. Loading aid according to claim 1, characterized in that the panel (110) is configured as a plan-parallel panel, whereof at least one lateral region (120) projecting beyond the lateral faces (220, 230) of the slide (200) is oriented at a predefined angle to main surfaces of the panel (110) which main surfaces are plan-parallel to one another.

4. Loading aid (100) according to claim 3, characterized in that the angle is between 30° and 70°.

5. Loading aid (100) according to claim 3, characterized in that the angle is roughly 45°.

6. Loading aid (100) according to claim 3, characterized in that the at least one lateral region (120) of the panel (110) projects 1 mm to 5 mm beyond a respective lateral face (220, 230) of the slide (200).

7. Loading aid (100) according to claim 3, characterized in that the at least one lateral region (120) of the panel (110) projects roughly 3 mm beyond a respective lateral face (220, 230) of the slide (200).

8. Loading aid (100) according to claim 3, characterized in that a lateral region (120, 130) of the panel (110) which projects beyond a respective lateral face (220, 230) of the slide (200) is provided with grooving.

9. Loading aid (100) according to claim 8, characterized in that three to five groove edges are formed in a lateral region (120, 130) of the panel (110) which projects beyond a respective lateral face (220, 230) of the slide (200).

10. A loading aid according to claim 1 wherein:

a firing pin spring (300) has a rear end portion in a spring cap;

the spring cap is accommodated in a recess in the panel in a first condition;

the panel has a pair of holes through which the spring cap can be depressed to a depressed condition; and in the depressed condition, the panel can be laterally slid out from the slide.

11. A method for using the loading aid according to claim 1 comprising grasping the lateral regions (120, 130) to retract the slide.

12. A firearm comprising:

a slide;

a firing pin carried in a breech section of the slide;

a firing pin spring having a rear end portion in a spring cap; and a loading aid having a first condition installed to the slide at a rear end of the slide and having:

lateral regions (120, 130) protruding from respective sides of the slide in the first condition of the loading aid; and a central region between the lateral regions accommodated in a recess in the slide rear end in the first condition of the loading aid, wherein:

the spring cap is accommodated in the recess in the central region under spring bias in a first condition of the spring cap;

the central region has one or more holes through which the spring cap can be depressed to a second condition of the spring cap; and in the depressed condition, the loading aid can be slid out from the slide.

13. The firearm of claim 12 wherein:

surfaces of the slide and loading aid cooperate to retain the loading aid to the slide axially and vertically.

14. The firearm of claim 12 wherein:

in the depressed condition, the loading aid can be laterally slid out from the slide.

15. The firearm of claim 12 wherein:

the one or more holes are a pair of holes diametrically opposite each other.

16. The firearm of claim 1 wherein:

surfaces of the slide and loading aid cooperate to retain the loading aid to the slide axially and vertically.

17. Loading aid (100) for a firearm, the firearm having a slide (200) and the slide having lateral faces (220, 230) and a rear end face (210), wherein:

the loading aid projects beyond the lateral faces (220, 230) of the slide (200) and is attached in a region of the rear end face (210) of the slide (200);

the loading aid comprises a panel (110) projecting beyond the lateral faces (220, 230) of the slide (200) and having lateral regions (120, 130) lying opposite one another and is introduced into a horizontally oriented recess (211) in the rear end face (210) of the slide (200);

the panel has an upper edge (1101) and a lower edge (1102), the upper edge and the lower edge each having a step (1103); and the upper edge and the lower edge fit with the recess to allow lateral introduction and removal of the panel.

18. Loading aid (100) of claim 17 wherein:

the slide has slots cooperating receiving rails of the panel.

19. Loading aid (100) of claim 17 wherein:

the panel has an inner surface and an outer surface, the inner surface having height greater than height of the outer surface.

* * * * *